US005909978A

United States Patent [19]

Giordano et al.

[11] Patent Number: 5,909,978

[45] Date of Patent: Jun. 8, 1999

[54] MARKER PEN

[75] Inventors: Edward Giordano, Peachtree City; Howard A. Mercer, Fayetteville; John R. Miller, Woodstock, all of Ga.

[73] Assignee: Porex Surgical Inc., College Park, Ga.

[21] Appl. No.: 08/151,891

[22] Filed: Nov. 15, 1993

[51] Int. Cl.[6] ..... B43K 8/02; B43K 8/04

[52] U.S. Cl. ..... 401/188 A; 401/183; 401/184; 401/199; 401/188 R

[58] Field of Search ..... 401/183, 184, 401/186, 187, 188 R, 188 A, 198, 199

[56] References Cited

U.S. PATENT DOCUMENTS

| | | | |
|---|---|---|---|
| 550,763 | 12/1895 | Osmun | 401/198 |
| 1,271,457 | 7/1918 | Gaines | 401/188 R |
| 2,820,233 | 1/1958 | Steiner | 401/183 |
| 3,231,924 | 2/1966 | Lofgren . | |
| 3,457,014 | 7/1969 | Ward | 401/183 X |
| 3,481,677 | 12/1969 | Abrahamson | 401/198 |
| 3,777,949 | 12/1973 | Chiquiari-Arias . | |
| 3,781,122 | 12/1973 | Chesseman . | |
| 3,905,709 | 9/1975 | Bok | 401/183 |
| 3,947,136 | 3/1976 | Adams | 401/188 A |
| 3,949,871 | 4/1976 | Christensen et al. . | |
| 4,526,490 | 7/1985 | Welsh . | |
| 4,568,214 | 2/1986 | Abe et al. | 401/199 X |
| 4,732,504 | 3/1988 | Telli . | |

FOREIGN PATENT DOCUMENTS

| | | | |
|---|---|---|---|
| 99706 | 2/1984 | European Pat. Off. | 401/183 |
| 1461645 | 5/1969 | Germany | 401/198 |
| 1811081 | 6/1970 | Germany | 401/199 |
| 18883 | 9/1908 | United Kingdom | 401/198 |
| 2091994 | 8/1982 | United Kingdom | 401/198 |
| 2194138 | 3/1988 | United Kingdom | 401/199 |

*Primary Examiner*—Steven A. Bratlie
*Attorney, Agent, or Firm*—Lane, Aitken & McCann

[57] ABSTRACT

In a marking pen, the body of the marking pen containing the cartridge is made air tight except for the opening on the distal end to receive the marker nib and a vent hole. The walls of the pen body are made flexible and the vent hole is provided through the flexible walls near the distal end so that the cavity containing the cartridge can be pressurized by squeezing the body between the thumb and index finger, with the index finger covering the vent hole. The pressuring of the cartridge cavity applies hydraulic pressure to the nib to flush the nib with ink or unclog it.

11 Claims, 2 Drawing Sheets

Fig.1.

MARKER PEN

BACKGROUND OF THE INVENTION

This invention relates to marking pens such as surgical markers, and, more particularly, to a marking pen designed to prevent and reverse a condition of inoperability caused by clogging of the marking pen tip or nib.

Marking pens which are used on oil, grease or debris bearing surfaces frequently become inoperable because of clogging of the pen nib with fluid or debris picked up from the surface. Surgical marking pens, which are used by surgeons to mark out areas on the skin for incision, are particularly prone to this problem. The marking tips or nibs of the surgical marker pick up oil, moisture and debris from the skin of the patient and become clogged and essentially inoperative. The present invention provides a marking pen which avoids this clogging problem.

SUMMARY OF THE INVENTION

In accordance with the present invention, the walls of the marking pen surrounding a reservoir containing a cartridge saturated with marking fluid, are made flexible. A vent hole provided in the walls enclosing the reservoir is positioned so that the vent hole can be covered by the finger of the surgeon or other person using the marking pen while the marking pen is being used in a marking operation. To prevent the nib from being clogged or to unclog the nib, the user covers the vent hole with his finger and squeezes the walls of the reservoir to pressurize the reservoir. This action forces the marking fluid through the nib so that the nib is flushed with ink and prevents the nib from being clogged during a marking operation, thus enabling continuous marking on skin or other surfaces bearing oil or grease or debris uninterrupted by the nib becoming clogged. If the nib does become clogged, the pressure of the reservoir will force the clogging material from the pores of the nib and thus effectively unclog the nib.

DESCRIPTION OF A PREFERRED EMBODIMENT

Figure 1:
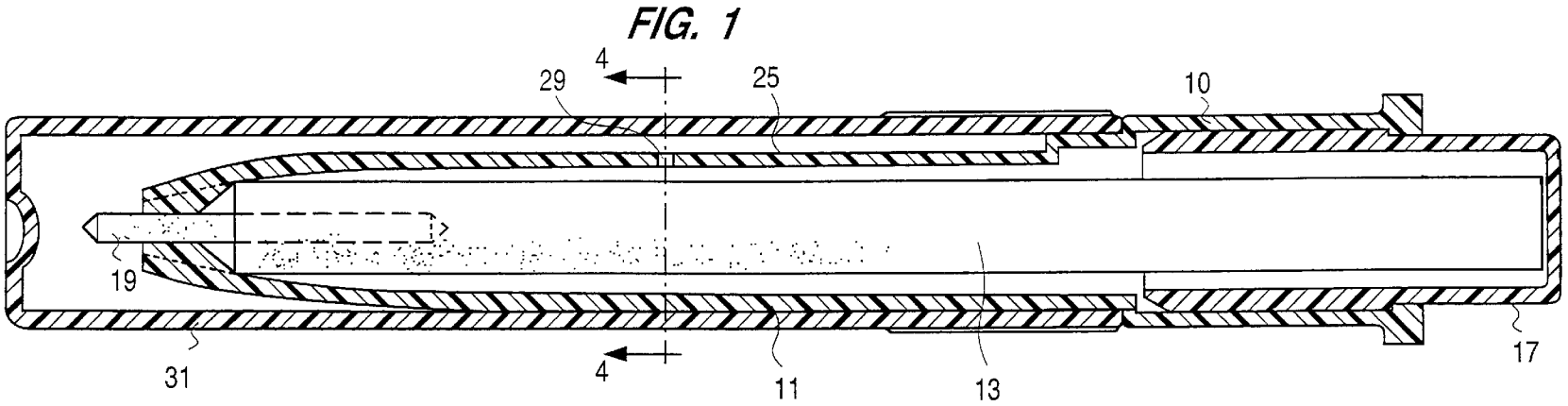
FIG. 1 is an axial sectional view of the marker pen of the present invention.
Figure 2:
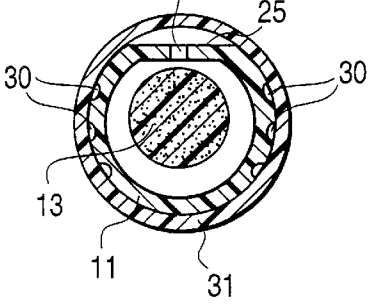
FIG. 2 is a cross-sectional view of the marker pen of the present invention taken along line 2—2 of FIG. 1.
Figure 3:
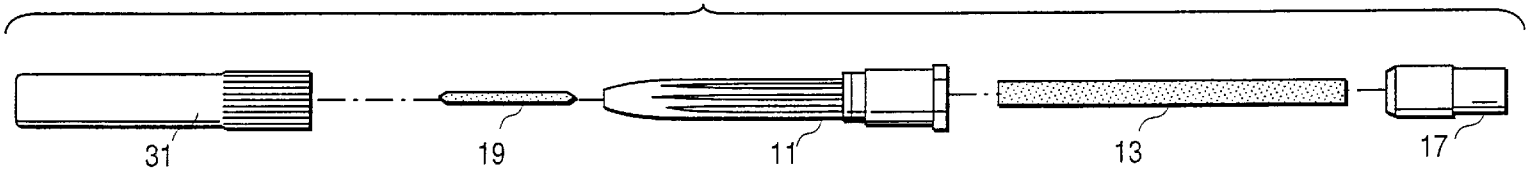
FIG. 3 is an exploded view of the marker pen of the invention in elevation.

As shown in the drawings, the marking pen comprises a generally cylindrical body 10 enclosing a hollow reservoir, which contains a porous cartridge 13 saturated with gentian violet ink. The cartridge 13 is made of compressed fibers and can be purchased from American Filtrona Corporation. The pen body 10 comprises a generally cylindrical barrel 11 which has an opening at its proximal end, which opening is closed by a hollow plug 17. The plug 17 is snapped into the open end of the barrel 11 to make a substantially air tight fit with the barrel 11. The barrel 11 and the plug 17 define the reservoir enclosure enclosing the cartridge 13.

The distal end of the barrel 11 defines a circular opening to receive a nib 19 also made of compressed fibers, but bound tightly with resin into a hard porous structure. The nib

19 is inserted through the circular opening in the distal end of the barrel and penetrates axially into the cartridge so that the pores of the nib are in capillary communication with the pores of the cartridge. The diameter of the opening in the distal end of the barrel 11 is slightly smaller than the diameter of the nib 19, e.g. 0.075 inches compared to 0.079 inches, so that the nib makes a force friction fit with the opening in a distal end of the barrel 11. Both ends of the nib 19 are ground to coaxial points to provide a point for marking and to facilitate the penetration of the nib axially into the cartridge 13.

The walls of the barrel 11 and plug 17 are made of high density polyethylene and the walls of the barrel 11 are flexible and resilient. The barrel is structured so as to be more flexible in the vertical direction as viewed in FIG. 1 than it is in the horizontal direction so that volume of the reservoir can be readily reduced by gently pressing the main section of the barrel between the index finger and thumb on the top and bottom of the main section of the barrel as viewed in FIG. 1. The barrel 11 is made to be more flexible or squeezeable in its vertical dimension than the horizontal dimension by forming the distal end of the barrel 11 beyond the plug 17 as a cylinder with a flattened upper surface 25 defined by a planar upper wall. In addition, each lateral side of the curved wall section of the distal end of the barrel 11 are provided with three angularly distributed axial grooves 30 in the outer surface of the barrel 11.

In the middle of the flattened surface 25, a vent hole 29 is provided defined through the planar wall section. The pen body 10 comprising the barrel 11 and the plug 17 is an airtight structure surrounding the reservoir containing the cartridge 13, except for the vent hole 29 and the opening in the distal end of the barrel 11 receiving the nib 19. The vent hole 29 is positioned so that when the pen is being used to mark, the index finger of the user can be placed over the hole to close it and, then, by squeezing the barrel 11 between the index finger and the thumb, the reservoir can be pressurized to force fluid out from the reservoir through the pen nib and flush the nib with ink or unclog the pores of the pen nib if they have been clogged. To be conveniently closed by the index finger of the user, the vent hole 29 should be located about 1.25 inches from the distal end of the barrel.

Figure 4:
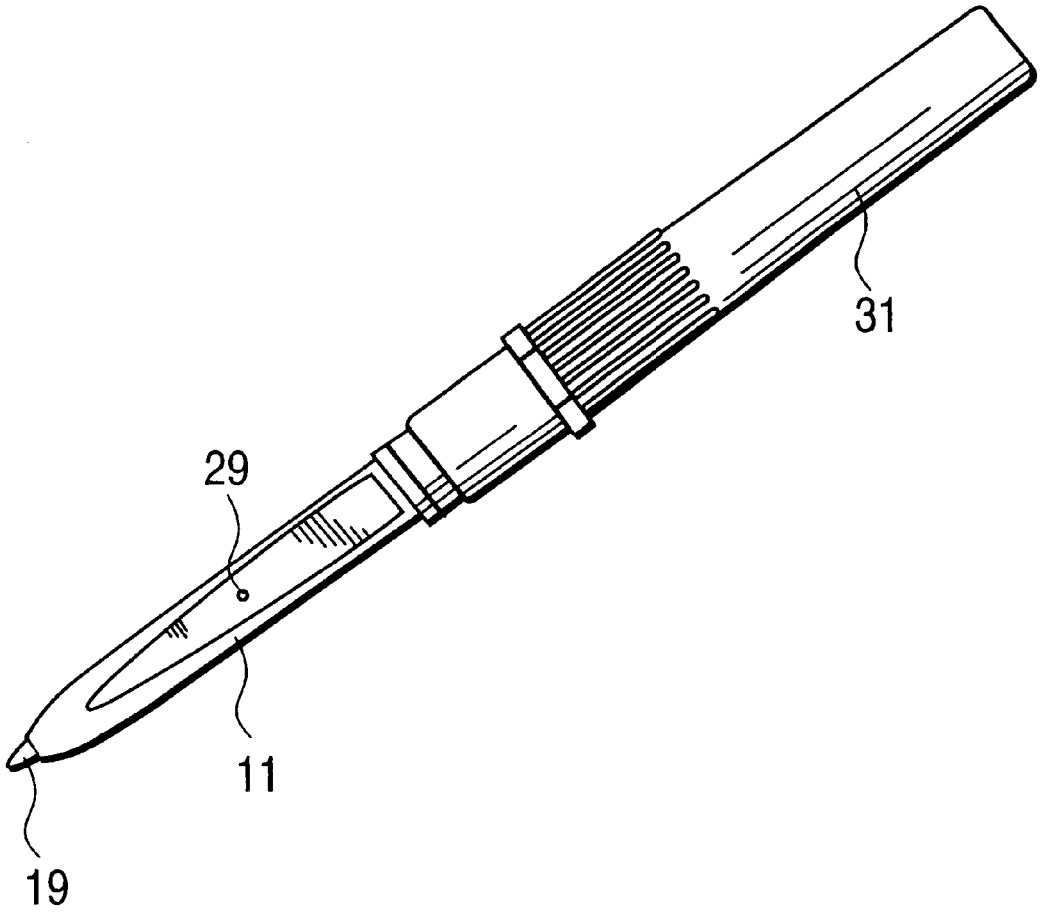
FIG. 4 is a view in elevation of the marker pen of the invention reassembled in its marking configuration.

A cap 31 is provided for covering the distal end of the barrel 11 to keep the nib 19 from drying out and prevent inadvertent marking. The cap 31 makes a releasable friction fit with a cylindrical section of the barrel 11 between the flattened surface 25 and the plug 17. When the cap is removed it can be placed over the plug 17 and makes a friction fit with the cylindrical wall of the plug 17 to provide an axial extension to the pen body making a configuration suitable for marking as shown in FIG. 4.

The above described construction enables the user to flush the nib with ink as he is marking simply by squeezing the barrel 11 with finger pressure between the thumb and the index finger with the index finger covering the vent hole 29. This action is accomplished with little or no change from the finger position used in marking with the surgical marker. As a result of the increase pressure in the reservoir, the gentian ink is forced out through the nib and flushes the nib with ink. This action enables the marker pen to mark on oil, grease or debris bearing surfaces, such as human skin. After the nib has become clogged, the squeezing action applies hydraulic pressure to clogged pores in the nib. The hydraulic pressure will unseat clogging material from the pores and thus unclog the nib.

The above description is the preferred embodiment of the invention and modification may be made there to without departing from the spirit and scope of the invention, which is defined in the pen in the appendant claims.

We claim:

1. A marking pen comprising a flexible body defining a cavity containing ink for the marker pen, an opening in the distal end of said body, a pen nib mounted in said opening, means to supply ink from said cavity to said pen nib, a vent hole in the flexible walls of said body positioned so that said body can be squeezed with a finger covering the vent hole to apply pressure to said cavity to flush said nib with ink.

2. A marking pen as recited in claim 1 wherein said means to supply ink from said cavity to said pen nib comprises a porous cartridge within said cavity in capillary communication with said nib and containing said ink.

3. A marking pen as recited in claim 1, wherein said body is cylindrical and is flexible so as to be squeezed by finger pressure across the diameter of the cylindrical body.

4. A marking pen as recited in claim 3 wherein one side of said cylindrical body is flattened to define a planar wall section in said cylindrical body, said vent hole being provided through said planar wall section.

5. A marking pen as recited in claim 3 wherein said vent hole is provided about 1.25 inches from the distal end of said pen body.

6. A marking pen as recited in claim 1 wherein said body comprises a hollow barrel having an open proximal end closed by a plug making an air tight fit with said barrel.

7. A marking pen as recited in claim 1 wherein said nib is comprised of a rigid porous synthetic resin.

8. A marking pen as recited in claim 4 wherein the pen has a single flat surface.

9. A method of unclogging a marking pen having a barrel having flexible sidewalls defining an ink reservoir, a vent in a location in said sidewalls where said sidewalls can be flexibly displaced, a writing nib and means to apply ink from said reservoir to said nib comprising increasing the pressure in said reservoir to force ink from said reservoir out through the pores of said nib to force clogging foreign matter from the pores of said nib by flexing said side walls while closing said vent with a finger.

10. A method of using a marking pen having a barrel having flexible sidewalls defining an ink reservoir, a vent in said sidewalls in a location in said sidewalls where said sidewalls can be flexibly displaced, a writing nib and means to apply ink from said reservoir to said nib comprising marking with said writing nib on a surface, and squeezing the barrel of said pen while sealing said vent with a finger and marking to increase the pressure in said reservoir to force ink from said reservoir through the pores of said nib to flush said nib with ink.

11. A method of as recited in claim 10, wherein said surface comprises human skin.

* * * * *

UNITED STATES PATENT AND TRADEMARK OFFICE

CERTIFICATE OF CORRECTION

PATENT : 5,909,978

DATED : June 8, 1999

INVENTOR(S) : Giordano, et al.

It is certified that error appears in the above-identified patent and that said Letters Patent is hereby corrected as shown below:

The title page showing the incorrect illustrative figure, should be deleted and substitute therefor the attached title page, showing the correct illustrative figure.

Signed and Sealed this

Second Day of May, 2000

*Attest:*

Q. TODD DICKINSON

*Attesting Officer*

*Director of Patents and Trademarks*

US005909978A

United States Patent [19]

Giordano et al.

[11] Patent Number: 5,909,978

[45] Date of Patent: Jun. 8, 1999

[54] MARKER PEN

[75] Inventors: Edward Giordano, Peachtree City; Howard A. Mercer, Fayetteville; John R. Miller, Woodstock, all of Ga.

[73] Assignee: Porex Surgical Inc., College Park, Ga.

[21] Appl. No.: 08/151,891

[22] Filed: Nov. 15, 1993

[51] Int. Cl.[6] ..... B43K 8/02; B43K 8/04

[52] U.S. Cl. ..... 401/188 A; 401/183; 401/184; 401/199; 401/188 R

[58] Field of Search ..... 401/183, 184, 401/186, 187, 188 R, 188 A, 198, 199

[56] References Cited

U.S. PATENT DOCUMENTS

| | | | |
|---|---|---|---|
| 550,763 | 12/1895 | Osmun | 401/198 |
| 1,271,457 | 7/1918 | Gaines | 401/188 R |
| 2,820,233 | 1/1958 | Steiner | 401/183 |
| 3,231,924 | 2/1966 | Lofgren . | |
| 3,457,014 | 7/1969 | Ward | 401/183 X |
| 3,481,677 | 12/1969 | Abrahamson | 401/198 |
| 3,777,949 | 12/1973 | Chiquiari-Arias . | |
| 3,781,122 | 12/1973 | Chesseman . | |
| 3,905,709 | 9/1975 | Bok | 401/183 |
| 3,947,136 | 3/1976 | Adams | 401/188 A |
| 3,949,871 | 4/1976 | Christensen et al. . | |
| 4,526,490 | 7/1985 | Welsh . | |
| 4,568,214 | 2/1986 | Abe et al. | 401/199 X |
| 4,732,504 | 3/1988 | Telli . | |

FOREIGN PATENT DOCUMENTS

| | | | |
|---|---|---|---|
| 99706 | 2/1984 | European Pat. Off. | 401/183 |
| 1461645 | 5/1969 | Germany | 401/198 |
| 1811081 | 6/1970 | Germany | 401/199 |
| 18883 | 9/1908 | United Kingdom | 401/198 |
| 2091994 | 8/1982 | United Kingdom | 401/198 |
| 2194138 | 3/1988 | United Kingdom | 401/199 |

*Primary Examiner*—Steven A. Bratlie
*Attorney, Agent, or Firm*—Lane, Aitken & McCann

[57] ABSTRACT

In a marking pen, the body of the marking pen containing the cartridge is made air tight except for the opening on the distal end to receive the marker nib and a vent hole. The walls of the pen body are made flexible and the vent hole is provided through the flexible walls near the distal end so that the cavity containing the cartridge can be pressurized by squeezing the body between the thumb and index finger, with the index finger covering the vent hole. The pressuring of the cartridge cavity applies hydraulic pressure to the nib to flush the nib with ink or unclog it.

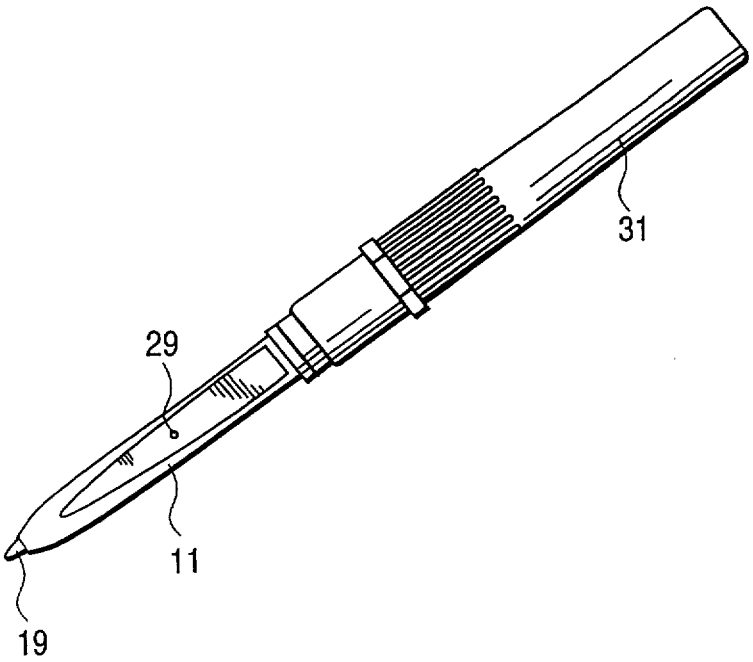

11 Claims, 2 Drawing Sheets